US011878835B2

(12) United States Patent
Piech

(10) Patent No.: US 11,878,835 B2
(45) Date of Patent: Jan. 23, 2024

(54) METALLIC CAN END

(71) Applicant: TOP CAP HOLDING GMBH, Kufstein (AT)

(72) Inventor: Gregor Anton Piech, Reith bei Kitzbuhel (AT)

(73) Assignee: TOP CAP HOLDING GMBH, Kufstein (AT)

( * ) Notice: Subject to any disclaimer, the term of this patent is extended or adjusted under 35 U.S.C. 154(b) by 497 days.

(21) Appl. No.: 17/253,447

(22) PCT Filed: Jun. 17, 2019

(86) PCT No.: PCT/EP2019/065879
§ 371 (c)(1),
(2) Date: Dec. 17, 2020

(87) PCT Pub. No.: WO2019/243254
PCT Pub. Date: Dec. 26, 2019

(65) Prior Publication Data

US 2021/0253300 A1 Aug. 19, 2021

(30) Foreign Application Priority Data

Jun. 19, 2018 (EP) ..... 18178571

(51) Int. Cl.
*B65D 17/28* (2006.01)

(52) U.S. Cl.
CPC ..... *B65D 17/4014* (2018.01); *B65D 17/404* (2018.01); *B65D 2517/004* (2013.01);
(Continued)

(58) Field of Classification Search
CPC ..... B65D 51/007; B65D 2577/2041; B65D 77/2028; B65D 17/401; B65D 17/38;
(Continued)

(56) References Cited

U.S. PATENT DOCUMENTS 3,990,603 A * 11/1976 Brochman ..... B65D 17/505 222/541.9
4,719,824 A * 1/1988 Chagoya ..... B67B 7/403 220/274

(Continued)

FOREIGN PATENT DOCUMENTS

CN 85107914 A 5/1987
CN 1596162 A 3/2005

(Continued)

OTHER PUBLICATIONS

DE Office Action and Extended Search Report, Application No. 20185471.8-1017, dated Oct. 9, 2020.

(Continued)

*Primary Examiner* — Kareen K Thomas
(74) *Attorney, Agent, or Firm* — Vivacqua Crane, PLLC

(57) ABSTRACT

A metallic can end having a reclosable opening has a microgap or a weakening line peripherally around the opening, a sealing frame composed of plastic material surrounding the opening region, a closure unit composed of plastic that is disposed within the microgap or weakening line and that is pivotably attached to the fixed end surface via a pivot bearing. The sealing frame and the closure unit cooperate in a sealing manner. The metallic end region disposed within the peripheral microgap or the weakening line is received and held in the opening region of the end. The sealing frame is bonded to the fixed end surface and the closure unit is bonded to the upwardly pivotable metallic end region. Except for a possibly provided lacquer layer, the inner end side is at least largely free of lamination and the like.

16 Claims, 6 Drawing Sheets

(52) U.S. Cl.
CPC ..... *B65D 2517/0013* (2013.01); *B65D 2517/0064* (2013.01); *B65D 2517/0082* (2013.01)

(58) Field of Classification Search
CPC .... B65D 17/36; B65D 17/353; B65D 17/347; B65D 17/30; B65D 17/32; B65D 17/34; B65D 17/28; B65D 17/4014; B65D 17/404; B65D 2517/0013; B65D 2517/004; B65D 2517/0064; B65D 2517/0082
See application file for complete search history.

(56) References Cited

U.S. PATENT DOCUMENTS

| | | | | |
|---|---|---|---|---|
| 2009/0102086 | A1 | 4/2009 | Sieverding et al. | |
| 2012/0071834 | A1 | 3/2012 | Harms et al. | |
| 2014/0041338 | A1 | 2/2014 | Zabaleta et al. | |
| 2015/0284136 | A1* | 10/2015 | Frishman | B65D 41/42 220/272 |
| 2016/0355306 | A1 | 12/2016 | Robin et al. | |
| 2018/0002065 | A1* | 1/2018 | Thielen | B65D 17/404 |
| 2018/0016058 | A1 | 1/2018 | Thielen et al. | |
| 2018/0186528 | A1* | 7/2018 | Tonn | G01F 11/16 |
| 2018/0186529 | A1* | 7/2018 | Tonn | B65D 43/16 |
| 2019/0055053 | A1 | 2/2019 | Piech | |
| 2019/0241309 | A1* | 8/2019 | Piech | B65D 17/4012 |
| 2020/0031520 | A1* | 1/2020 | Piech | B65D 17/404 |

FOREIGN PATENT DOCUMENTS

| | | | |
|---|---|---|---|
| CN | 1764576 | A | 4/2006 |
| CN | 201023709 | | 2/2008 |
| CN | 102414087 | A | 4/2012 |
| DE | 102006020696 | A1 | 11/2007 |
| DE | 102015112428 | A1 | 2/2017 |
| DE | 102010013531 | A1 | 10/2020 |
| EP | 2354022 | B1 | 8/2011 |
| EP | 3189867 | A1 | 7/2017 |
| FR | 2241460 | A1 | 3/1975 |
| IT | 950725 | | 5/2000 |
| JP | 0245354 | A | 3/1975 |
| JP | 5483590 | A | 3/1975 |
| WO | 2010115820 | A1 | 10/2010 |
| WO | 2017148659 | A1 | 9/2017 |

OTHER PUBLICATIONS

WO Extended Search Report and Written Opinon, Application No. PCT/EP2019/065879, dated Sep. 4, 2019.

* cited by examiner

Fig.15
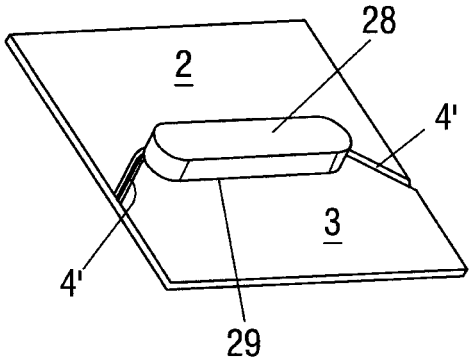
Fig.16
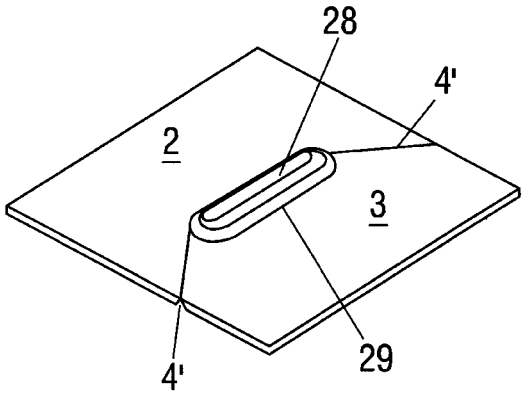
Fig.17
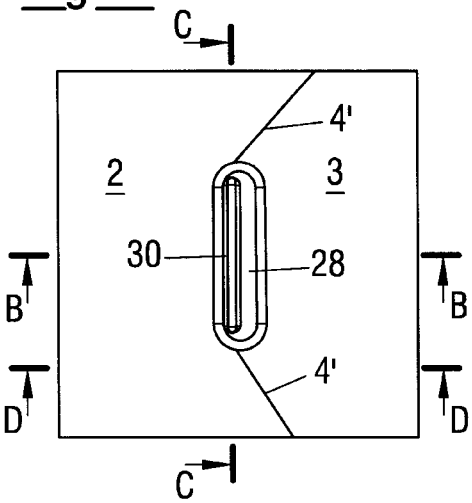
Fig.19
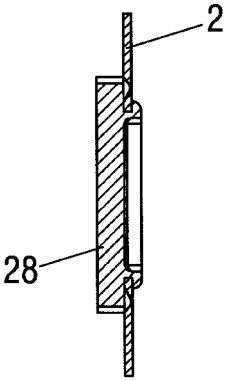
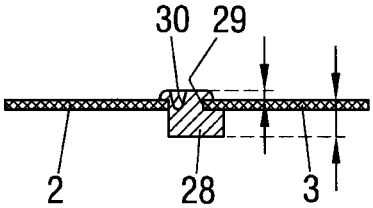
Fig.18
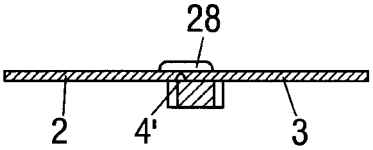
Fig.20

METALLIC CAN END

CROSS REFERENCE TO RELATED APPLICATIONS

This application is a national stage application under 35 U.S.C. 371 of PCT Application No. PCT/EP2019/065879 having an international filing date of 17 Jun. 2019, which PCT application claimed the benefit of European Patent Application No. 18178571.8 filed 19 Jun. 2018, the entire disclosure of each of which are hereby incorporated herein by reference.

TECHNICAL FIELD

The present invention relates to a metallic can end having a reclosable opening, in particular for beverage cans and for containers for storing foodstuffs and other liquid, pasty, powdery and/or solid products.

INTRODUCTION

A can end having a reclosable opening is known from EP 1 607 341 A1 in which an opening is introduced in the metallic can end and the margin of this opening is beaded to create an anchorage possibility for a prefabricated plastic closure part. The plastic closure part includes a base part which is to be connected to the bead rim of the can opening and in which an opening closed by a flat stopper is formed. The flat stopper is connected to the opening margin via a plastic tear seam so that the flat stopper connected to a tear tab can be released from the base plastic part via the tear tab by exertion of a pull and can be pivoted into an opening point. The opening can be temporarily closed again by pressing in the flat stopper which is preferably conical at its lower side.

Reclosable can ends are furthermore described, for example, in DE 10 2010 013 531 A1, DE 10 2015 112 428 A1 and EP 2 354 022 B1.

SUMMARY

It is the object of the invention to provide a reclosable can end that is particularly favorable in manufacture and that, on the one hand, is nevertheless particularly easy to actuate and, on the other hand, has good sealing properties.

This object is satisfied by a metallic can end having the features of claim 1.

A microgap ensures a particularly simple opening of the can end, but a weakening line is also generally suitable. An effective closure and reclosing can be achieved via the sealing and latching ribs and via the associated reception grooves. It is particularly advantageous in this respect that the sealing frame is bonded to the fixed end surface and the closure unit is bonded to the upwardly pivotable metallic end region. The dispensing with of laminations and the like, for example plastic films, on the inner side of the can end produces an inexpensive manufacture.

The manufacture is particularly favorable if the total inner end side except for a possibly provided lacquer layer is free of laminations and the like. The sealing frame and the closure unit then only have to be attached to the outer end side and fixedly connected to the end during manufacture. The inner side can be covered by a lacquer layer that is in particular suitable for use in foodstuffs. The application of such a lacquer layer onto the raw end material can already take place in an inexpensive manner. The punched edges of a microgap can be subsequently covered by lacquer again, for example by spraying or tampon printing.

In accordance with another preferred embodiment of the invention, the inner end side is provided with a sealing film that covers the microgap or the weakening line, but leaves the region disposed outside thereof free. Only a relatively small film is therefore required that can additionally be formed as completely planar. Both the manufacture of the film and the connection of the film to the inner end side can thereby be carried out particularly simply and inexpensively.

In accordance with a further preferred embodiment of the invention, the sealing film has an annular shape corresponding to the shape of the microgap or of the weakening line. In this respect, the film can only extend a few tenths of a millimeter, in particular 3 to 4 tenths of a millimeter beyond both sides of the microgap or weakening line. A secure covering of the microgap or weakening line can thus be achieved by a very small film, whereby the manufacturing costs are further reduced, on the one hand, and the manufacture is itself simplified, on the other hand.

In accordance with another embodiment of the invention, the sealing film is in disk-shape and covers the total region within the microgap or weakening line. This film likewise only has to extend a few tenths of a millimeter outwardly beyond the microgap or weakening line, preferably 3 to 4 tenths of a millimeter. The disk shape is in turn very simple to manufacture and to attach to the inner end side. Costs are thereby in turn saved in manufacture.

The film can be manufactured particularly favorably if it is formed as punched part.

In accordance with a further preferred embodiment of the invention, the closure unit covers the microgap or the weakening line from the outside as long as the end is not open. An imperviousness of the end can thereby also be achieved without a film on the inner cover side. The closure unit here preferably covers the microgap or the weakening line at both sides by at least 0.3 millimeters, in particular by approximately 1 millimeter.

In accordance with a further embodiment of the invention, the closure unit has a first sealing region that is arranged fully peripherally radially within the microgap or weakening line and is connected, in particular bonded, in a manner such that it cannot be torn open to the upwardly pivotable metallic end region and has a second sealing region that is arranged fully peripherally radially outside the microgap or weakening line and is connected, in particular bonded, to the fixed end surface such that it is releasable from the fixed end surface on a tearing open of the end cover with a predefined maximum force. The maximum force here preferably amounts to 10 N or less, in particular 5 N or less. An advantageous sealing of the inner container space with respect to the outer space is produced by these sealing regions, with a desired closure strength being able to be set. With a microgap in a can end without an inner film, the sealing and the closure strength are achieved solely by the closure unit; to a large extent with an end having a weakening line.

On a first opening of the can end, the seal between the closure unit and the fixed end region is released in the manner of a peel closure. The seal between the closure unit and the upwardly pivotable end region is maintained, in contrast. When the can end is reclosed, the imperviousness is then effected by the seal between the closure unit and the upwardly pivotable end region, on the one hand, and between the sealing frame and the closure unit, on the other hand.

In accordance with a preferred further development, the upwardly pivotable end region has a kind of droplet shape with a pointed region at the point of engagement of the tear-open member and a round region at the end remote therefrom at the pivot bearing. An advantageous tear-open behavior hereby results, in particular with respect to the seal between the closure unit and the fixed end region.

In accordance with a further embodiment of the invention, the can end has an elongate hole in the region of the tear-open member which is adjoined at both sides by the microgap or by the weakening line, wherein a plastic part is sealingly inserted into the elongate hole, in particular by a mushroom-shaped design at both sides of the end and a bonded connection to the can end, and wherein the plastic part is in turn provided with a weakening line that connects the opposite ends of the microgap or of the weakening line of the metallic can end to one another. The weakening line in the plastic part can in particular be produced by imprinting on the establishment of the seal. The opening forces can thereby be advantageously reduced.

In accordance with a further embodiment of the invention, the weakening line in the can end is formed by a pressed sharp-edged notch. In accordance with another embodiment of the invention, the weakening line is produced by a deep drawing of the can end material. A very thin-walled tear-open line that can be easily torn open can be formed by this last-named variant. However, the sharp-edged notch also provides advantageous tear-open properties.

To produce a metallic can end of the previously described kind in which both the sealing frame is bonded to the fixed end surface and the closure unit is bonded to the upwardly pivotable metallic region, in particular by a thermal process, using a bonding agent, in particular an adhesive lacquer, that is preferably suitable for use in foodstuffs and/or that has lubrication properties, the bonding agent is preferably admixed to the respective plastic material before the demolding of the sealing frame and/or of the closure unit. The bonding agent can in particular be admixed to a plastic granulate that is used to produce an injection molded plastic part. A separate application of the bonding agent to said parts is thereby dispensed with, whereby the manufacturing costs can be lowered.

In a further method of manufacturing a metallic can end of the described kind having a plastic film, in particular on the inner end side, in particular to seal a microgap in the can end, that is bonded to the metallic can end, in particular by a thermal process, using a bonding agent, in particular an adhesive lacquer, the bonding agent is preferably formed as a film. This is also favorable to manufacture since the two films can easily be connected to one another.

The bonding agent film is particularly preferably manufactured with the plastic film as a two-layer film, in particular by coextrusion. The manufacture is thereby even simpler and less expensive.

The bonding agent can otherwise also be applied as an adhesive lacquer to one or both of the parts to be connected, that is to the metallic end material and/or to the sealing frame, and to the closure unit, and the sealing film.

BRIEF DESCRIPTION OF THE DRAWINGS

An embodiment of the invention is represented in the drawing and will be described in the following. There are shown, schematically in each case FIG. 1 a perspective view of a can end in accordance with the invention;

FIG. 15 a plastic part inserted into a can end in accordance with the invention;

FIG. 16 the plastic part of FIG. 15 after a mushroom-like deformation;

FIG. 17 a plan view of the section of a can end in accordance with the invention;

FIG. 18 a section in accordance with the line B-B in FIG. 17;

FIG. 19 a section in accordance with the line C-C in FIG. 17; and

FIG. 20 a section in accordance with the line D-D in FIG. 17.

DETAILED DESCRIPTION

Figure 1:
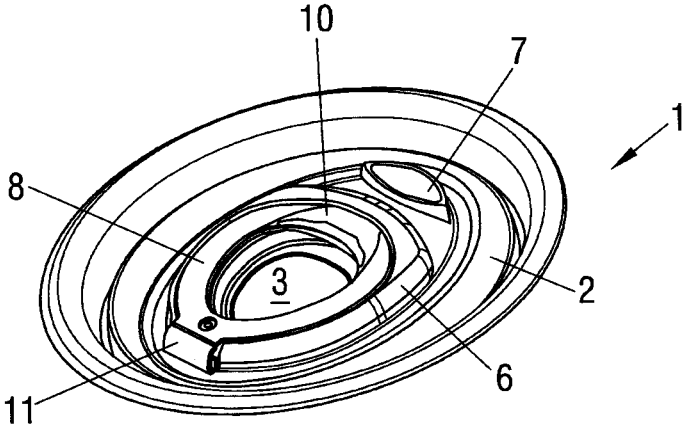
Figure 2:
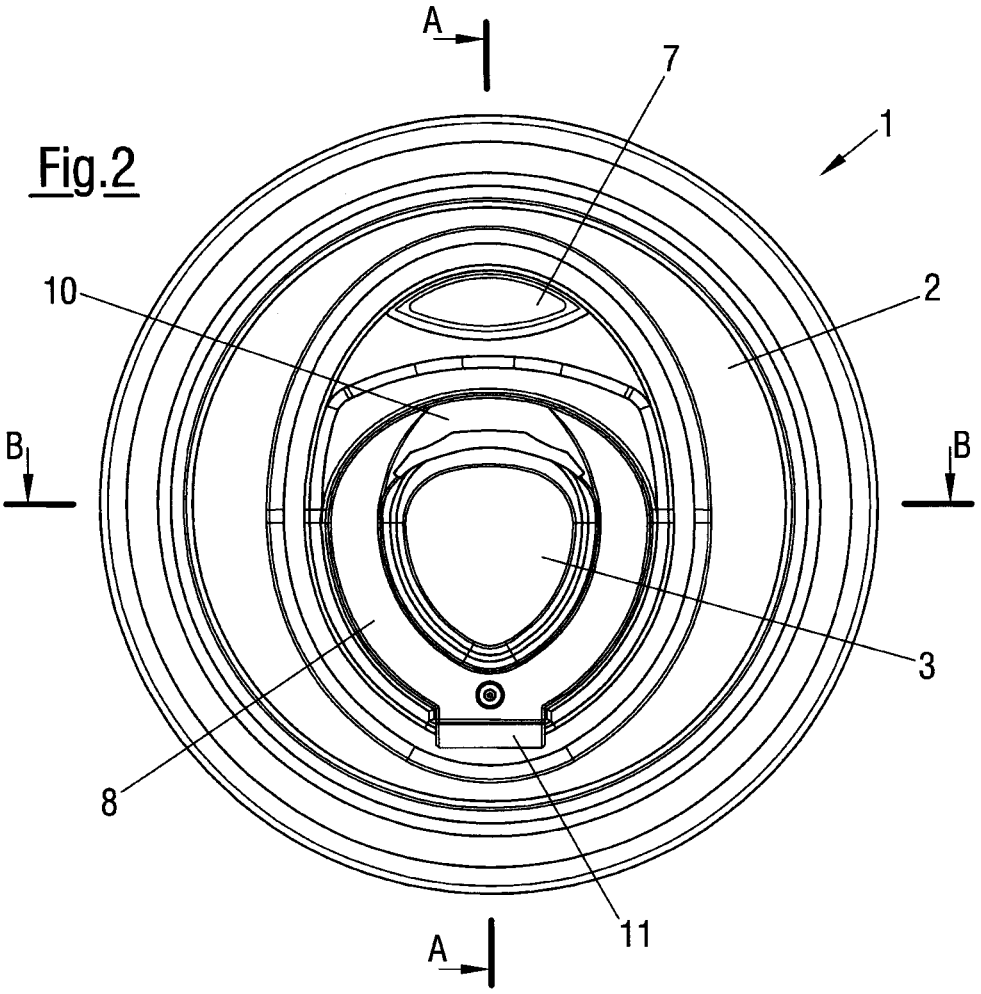
FIG. 2 a plan view of the upper side of the can end of FIG. 1.

The can end 1 shown in the Figures comprises metal, in particular aluminum, and has a reclosable opening. An upwardly pivotable end region 3 is provided beside a fixed end surface 2 for this purpose. The upwardly pivotable end region 3 is separated from the fixed end region 2 by a peripheral microgap 4 or by a weakening line (see in particular FIG. 6).

A sealing frame 5 that is composed of plastic material and that surrounds the opening region is connected to the fixed end surface 2, and indeed in particular by a so-called hot melt process using a bonding agent to ensure a firm connection with the aluminum of the end. A closure unit 6 that is likewise composed of plastic and that is pivotably connected via a pivot bearing 7 to the fixed end surface 2 is furthermore attached to the upwardly pivotable metallic end region 3. The pivot bearing 7 and the closure unit 6 are in turn in particular connected to the fixed end surface 2 or to the upwardly pivotable end region 3 via a hot melt connection using a bonding agent.

The closure unit is connected at the side diametrically opposite the pivot bearing 7 to an upwardly pivotable tear-open member 8 that is arranged in parallel with the upper end side 9 in the non-upwardly pivoted state. The tear-open member 8 is formed as annular in a known manner and can be pivoted upwardly about a pivot bearing 11 by being engaged by a finger in an engagement end 10 opposite the end surface.

The sealing frame 5 and the closure unit 6 cooperate in a sealing manner via sealing and latching ribs 12, 13, 14 at the sealing frame 5 and via associated reception grooves 15, 16, 17 at the closure unit 6. At least three sealing edges 18, 19, 20 are thereby formed by which the opening region of the can end is sealed. An imperviousness of the can end is thereby also ensured when using a microgap 4 between the upwardly pivotable end region 3 and the fixed end region 2.

Figure 5:
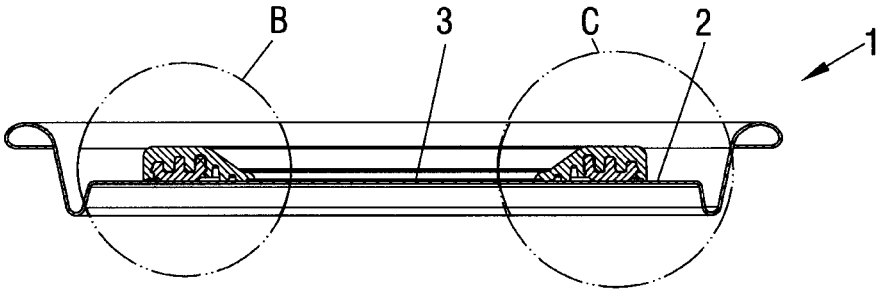
FIG. 5 a section corresponding to FIG. 4 through a variant of a can end in accordance with the invention.
Figure 6:
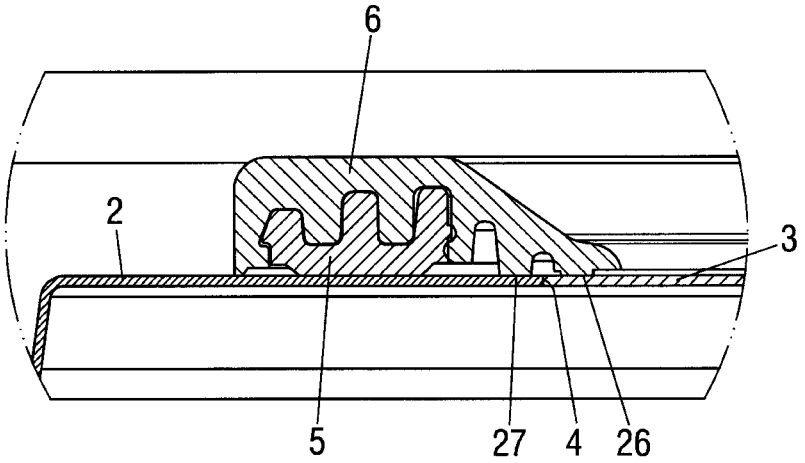
FIG. 6 detail B of FIG. 5.
Figure 7:
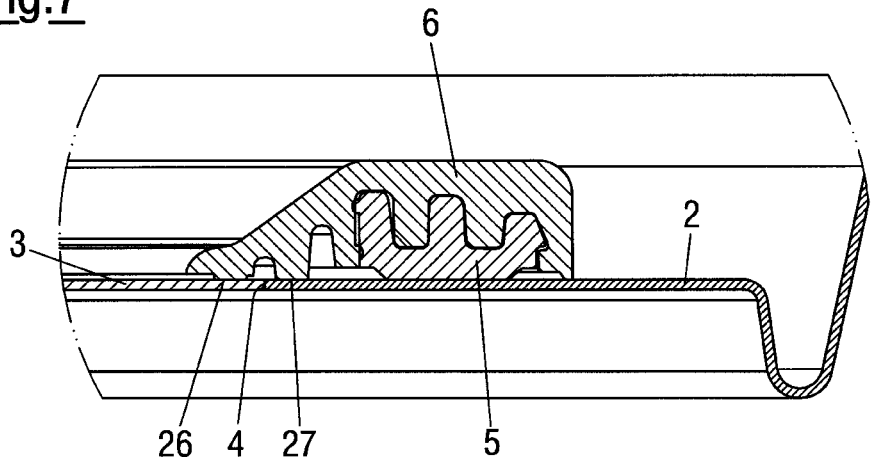
FIG. 7 detail C of FIG. 5.

The can end 1 is provided with a microgap 4 in the embodiment of FIGS. 5 to 7. It is gripped over by the closure unit 6, with a first sealing region 26 being formed between the closure unit 6 and the upwardly pivotable end region 3 and a second sealing region 27 between the closure unit 6 and the fixed end region 2. The first sealing region is configured such that the closure unit 6 is connected to the upwardly pivotable end region 3 in a manner such that it cannot be torn open. In contrast, the second sealing region 27 is configured such that it is releasable from the fixed end region 2 on a tearing open of the can end 1 with a predefined maximum force. The maximum force is here preferably 10 N, in particular 5 N. Both sealing regions 26, 27 are formed fully peripherally around the opening region of the can end so that the interior of the can is completely sealed by these two sealing regions.

Figure 14:
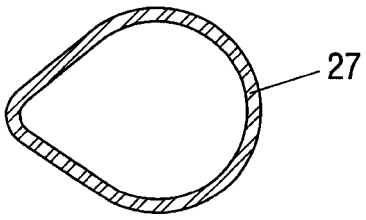
FIG. 14 a plan view of the opening region of a can end in accordance with the invention.

The sealing in the first sealing region 26 and in the second sealing region 27 preferably takes place in a bonded manner by a thermal process, in particular by a so-called hot melt process. The shape of the sealing surfaces 26, 27 is, as shown in FIG. 14, preferably of droplet shape.

Figure 8:
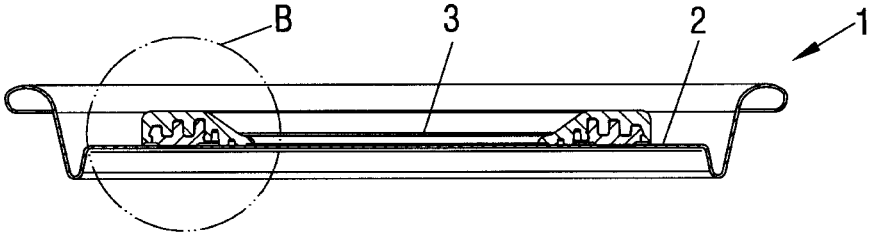
FIG. 8 a section corresponding to FIG. 4 through a further variant of a can end in accordance with the invention.
Figure 9:
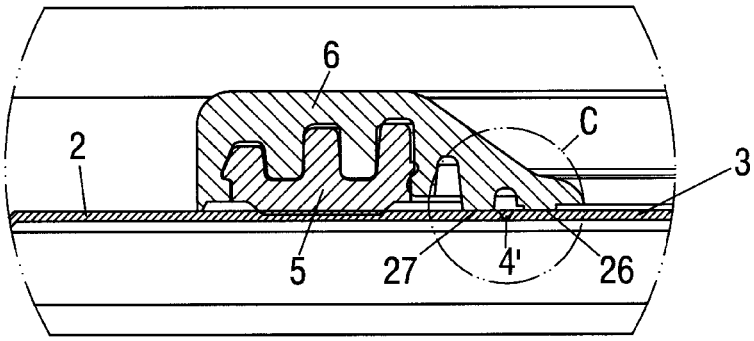
FIG. 9 detail B of FIG. 8.
Figure 10:
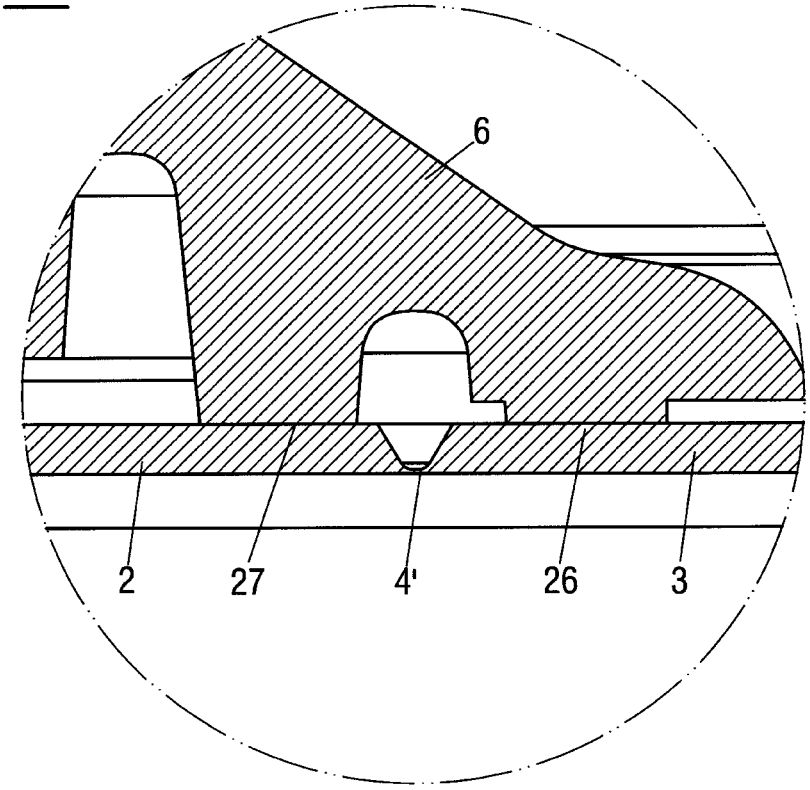
FIG. 10 detail C of FIG. 9.

FIGS. 8 to 10 show a further variant of a can end in accordance with the invention having a first sealing region 26 between the closure unit 6 and the upwardly pivotable end region 3 as well as a second sealing region 27 between the closure unit 6 and the fixed end region 2 that are each formed in accordance with the preceding variant. The difference from the preceding variant comprises a weakening line 4' being provided between the fixed end region 2 and the upwardly pivotable end region 3 here instead of a microgap 4. The weakening line 4' is here formed as a sharp-edged notch.

Figure 11:
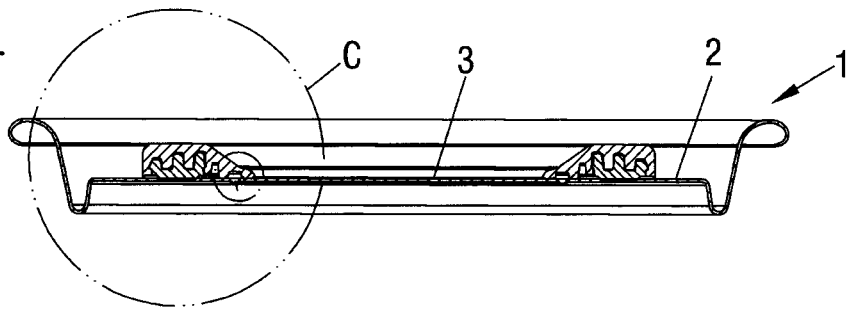
FIG. 11 a section corresponding to FIG. 4 through another variant of a can end in accordance with the invention.
Figure 12:
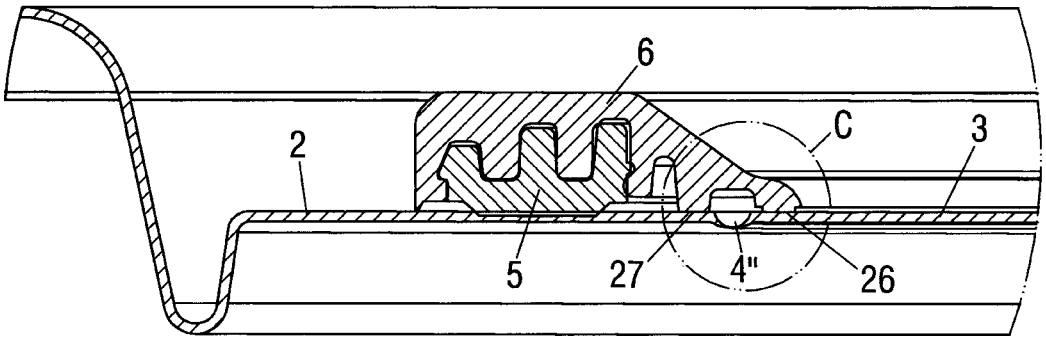
FIG. 12 detail B of FIG. 11.
Figure 13:
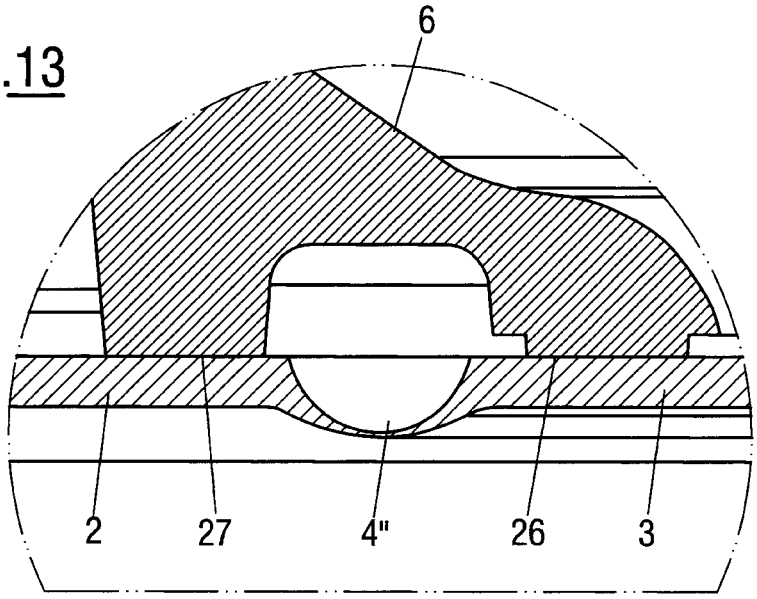
FIG. 13 detail C of FIG. 12.

In the variant shown in FIGS. 11 to 13, a weakening line 4" is likewise provided between the fixed end region 2 and the upwardly pivotable end region 3. Unlike the preceding variant, it is formed as a deep-drawn deformation. The weakening line 4" is likewise gripped over by the closure unit 6, with a first sealing region 26 being provided between the closure unit 6 and the upwardly pivotable end region 3 and a second sealing region 27 being provided between the closure unit 6 and the fixed end region 2. The remaining configuration is again as in the previously described variants.

In the variant shown in FIGS. 15 to 20, a plastic part 28 is inserted into an elongate hole 29 provided in the can end 1. The microgap 4 respectively adjoins the two narrow ends of the elongate hole 29. As can easily be seen in FIG. 16, the plastic part 28 is deformed in a mushroom-like manner to engage at both sides over the fixed end region 2, on the one hand, and the upwardly pivotable end region 3, on the other hand. FIG. 15 shows the non-deformed state.

The plastic part 28 deformed in a mushroom-like manner is bonded to the can end 1, in particular by a thermal process using a bonding agent. In addition, a weakening line 30 is imprinted into the plastic part 28 and is preferably established during the sealing process of the can end 1. The plastic part can be separated into two parts on the tearing open of the can end through this weakening line 30. The opening forces are here smaller than without the plastic part 28.

Figure 3:
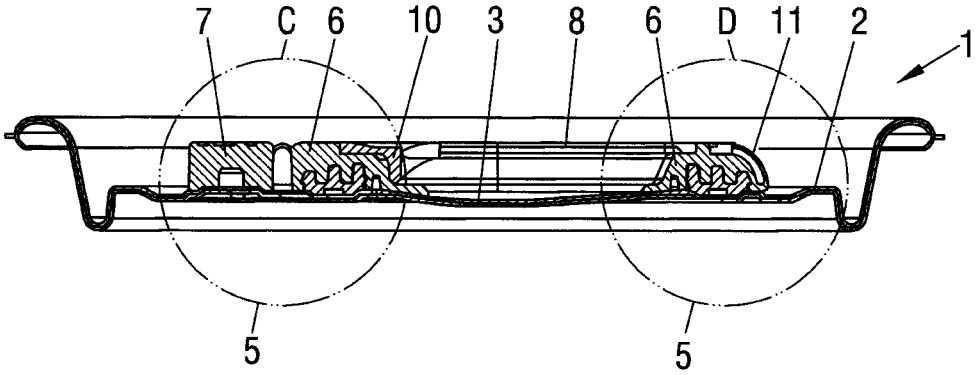
FIG. 3 a section in accordance with the line A-A in FIG. 2.
Figure 4:
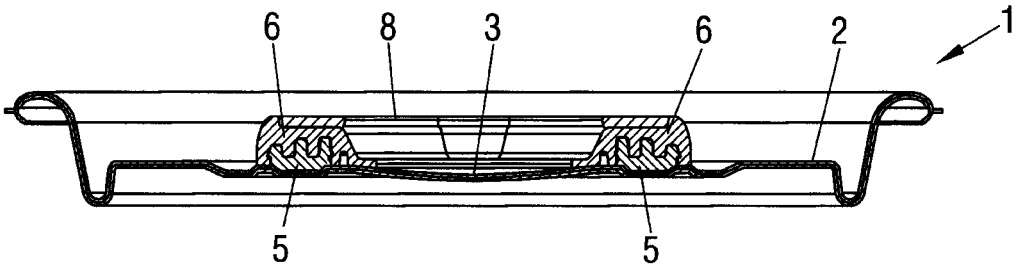
FIG. 4 a section in accordance with the line B-B in FIG. 2.

In the embodiment shown in FIGS. 3 and 4, the inner side of the can end is laminated with a plastic film 25 that covers the total inner end side. Differing from this, the plastic film can also be formed as annular and can only extend a few tenths of a millimeter, in particular 3 to 4 tenths of a millimeter, at both sides beyond the microgap 4 or the weakening line. A different possibility comprises using a disk-shaped sealing film that extends a few tenths of a millimeter, for example 3 to 4 tenths of a millimeter, radially outwardly beyond the microgap 4 or the weakening line. The sealing film can be formed as a largely flat disk in this case. Both the annular and the disk-shaped sealing film are preferably formed as stamped parts.

Whereas the sealing frame 5 and the closure unit 6 are always attached to the outer side of the can end 1 and are connected to the can end via a bonding agent, the inner end side can also, differing from the embodiment, be at least largely free of laminations and the like. The inner end side can, however, be provided with a lacquer layer, in particular suitable for use in foodstuffs, to prevent a contact of the product contained in the can with the metallic end material.

The embodiments shown in FIGS. 5 to 13 show can ends without a sealing film. An imperviousness of the can end and a closure strength are nevertheless ensured by the sealing regions 26 and 27 and by the sealing and latching ribs 12, 13, and 14 with the associated reception grooves 15, 16, 17.

REFERENCE NUMERAL LIST

1 can end
2 fixed end region
3 upwardly pivotable end region
4 microgap
4', 4" weakening line
5 sealing frame
6 closure unit
7 pivot bearing
8 tear-open member
9 upper can side
10 engagement end
11 pivot bearing of 8
12 sealing and latching rib
13 sealing and latching rib
14 sealing and latching rib
15 reception groove
16 reception groove
17 reception groove
18 sealing edge
19 sealing edge
20 sealing edge
21 hook
22 projection
23 aperture
24 prolongation
25 sealing film
26 first sealing region
27 second sealing region
28 plastic part
29 elongate hole
30 weakening line

The invention claimed is:

1. A metallic can end having a reclosable opening, the metallic can end having an inner end side and an outer end side, the metallic can end having an upwardly pivotable metallic end region abutting a fixed end surface along a peripheral microgap or a weakening line provided in a surface of the metallic can end and peripherally around an opening region, having a sealing frame composed of plastic material connected to the fixed end surface and surrounding the opening region, having a closure unit composed of plastic that is disposed within the microgap or the weakening line, that is connected to the upwardly pivotable metallic end region, and that is pivotably attached to the fixed end surface via a pivot bearing, wherein the sealing frame and the closure unit cooperate in a sealing manner, and the upwardly pivotable metallic end region disposed within the peripheral microgap or the weakening line is received and held in the opening region of the end, wherein the sealing frame is bonded to the fixed end surface and the closure unit is bonded to the upwardly pivotable metallic end region on the outer end side, and wherein the inner end side is free of lamination, and wherein the closure unit covers the microgap or the weakening line from an outside as long as the end is not open.

2. The can end in accordance with claim 1, wherein the inner end side is totally free of laminations.

3. The can end in accordance with claim 1, wherein the inner end side is provided with a sealing film that covers the microgap or the weakening line, but leaves the region of the inner end side disposed outside it free.

4. The can end in accordance with claim 3, wherein the sealing film has an annular shape corresponding to the shape of the microgap or of the weakening line.

5. The can end in accordance with claim 4, wherein the sealing film extends at both sides only by a few tenths of a millimeter, beyond the microgap or the weakening line.

6. The can end in accordance with claim 3, wherein the sealing film is of disk shape and covers a total region within the microgap or the weakening line.

7. The can end in accordance with claim 3, wherein the sealing film is formed as a stamped part.

8. The can end in accordance with claim 1, wherein the closure unit covers the microgap or the weakening line at both sides by at least 0.3 millimeter.

9. The can end in accordance with claim 1, wherein the closure unit has a first sealing region that is arranged fully peripherally radially within the microgap or the weakening line and is connected in a manner such that when the can is torn open, the closure unit remains fixed to the upwardly pivotable metallic end region and a second sealing region that is arranged fully peripherally radially outside the microgap or weakening line and is connected to the fixed end surface such that it is releasable from the fixed end surface on a tearing open of the can end with a predefined maximum force.

10. The can end in accordance with claim 1, wherein the closure unit is provided with a tear-open member that is connected to the closure unit in an upwardly pivotable manner diametrically opposite the pivot bearing.

11. The can end in accordance with claim 1, wherein the sealing frame and the closure unit cooperate in a sealing manner via sealing and latching ribs and associated reception grooves.

12. The can end in accordance with claim 1, wherein the sealing frame is connected to the fixed end surface and the closure unit is connected to the upwardly pivotable metallic end region, in each case by a thermal process using a bonding agent layer.

13. The can end in accordance with claim 12 wherein the bonding agent layer is an adhesive lacquer layer.

14. The can end in accordance with claim 12 wherein the bonding agent layer is suitable for use in foodstuffs and/or has lubrication properties.

15. The can end in accordance with claim 10, wherein the upwardly pivotable end region has a kind of droplet shape with a pointed region at the point of engagement of the tear-open member and a round region at the end remote therefrom at the pivot bearing.

16. The can end in accordance with claim 10, wherein the can end has an elongate hole in the region of the tear-open member which is adjoined at both sides by the microgap or by the weakening line; and wherein a plastic part is sealingly inserted into the elongate hole; and wherein the plastic part is in turn provided with a weakening line that connects the opposite ends of the microgap or of the weakening line of the metallic can end to one another.

* * * * *